US005551962A

United States Patent [19]

Ho

[11] Patent Number: 5,551,962

[45] Date of Patent: Sep. 3, 1996

[54] ABRASIVE ARTICLES AND METHOD OF MAKING ABRASIVE ARTICLES

[75] Inventor: Kwok-Lun Ho, Woodbury, Minn.

[73] Assignee: Minnesota Mining Manufacturing Company, St. Paul, Minn.

[21] Appl. No.: 589,998

[22] Filed: Jan. 23, 1996

Related U.S. Application Data

[63] Continuation of Ser. No. 538,183, Aug. 23, 1995, abandoned, which is a continuation of Ser. No. 214,394, Mar. 16, 1994, abandoned.

[51] Int. Cl.[6] ..... C09K 3/14

[52] U.S. Cl. ..... 51/306; 51/294; 51/295; 51/298; 51/304; 51/307; 428/403

[58] Field of Search ..... 51/293, 294, 295, 51/298, 306, 307, 304; 428/357, 403, 407

[56] References Cited

U.S. PATENT DOCUMENTS

| | | | |
|---|---|---|---|
| 1,025,382 | 5/1912 | Dagnall | 51/294 |
| 1,573,061 | 2/1926 | Hartmann | 51/295 |
| 1,844,064 | 2/1932 | Hartmann | 51/295 |
| 3,321,287 | 5/1967 | Hunsberger et al. | 51/295 |
| 3,502,453 | 3/1970 | Baratto | 51/295 |
| 3,869,834 | 3/1975 | Mullin et al. | 51/295 |
| 4,239,501 | 12/1980 | Wirth | 51/281 |
| 4,253,850 | 3/1981 | Rue et al. . | |
| 4,381,188 | 4/1983 | Waizer et al. | 51/307 |
| 4,609,380 | 9/1986 | Barnett et al. | 51/295 |
| 4,784,671 | 11/1988 | Elbel | 51/293 |
| 4,877,420 | 10/1989 | Buxbaum et al. . | |
| 5,078,753 | 1/1992 | Broberg et al. | 51/298 |
| 5,110,321 | 5/1992 | Broberg et al. | 51/295 |
| 5,221,295 | 6/1993 | Zador . | |
| 5,250,085 | 10/1993 | Mevissen | 51/298 |
| 5,269,821 | 12/1993 | Helmin et al. | 51/295 |
| 5,352,254 | 10/1994 | Celikkaya | 51/295 |
| 5,368,619 | 11/1994 | Culler | 51/295 |
| 5,378,251 | 1/1995 | Culler et al. | 51/295 |

FOREIGN PATENT DOCUMENTS

| | | | |
|---|---|---|---|
| 0299950A1 | 1/1989 | European Pat. Off. . | |
| 0418738A2 | 3/1991 | European Pat. Off. . | |
| 0464850A2 | 1/1992 | European Pat. Off. . | |
| 0486308A2 | 5/1992 | European Pat. Off. | B24D 3/34 |
| 3112954 | 12/1981 | Germany . | |
| WO92/05915 | 4/1992 | WIPO | B24D 11/00 |
| WO94/02562 | 2/1994 | WIPO . | |
| WO94/23898 | 10/1994 | WIPO . | |

OTHER PUBLICATIONS

Abstract of JP 58,211,860 (English Abstract), Dec. 9, 1983.

Chemical Abstracts, vol. 100, No. 22, "Grinding Wheels Improved Grinding Efficiency", May 28, 1984.

*Primary Examiner*—Deborah Jones

*Attorney, Agent, or Firm*—Gary L. Griswold; Walter N. Kirn; Doreen S. L. Gwin

[57] ABSTRACT

Abrasive articles are described that include a plurality of abrasive particles, a plurality of coated grinding aid particles, the coated grinding aid particles comprising grinding aid particles coated with an inert, hydrophobic, hydrocarbon-containing substance, and a binder in which the abrasive particles and the coated grinding aid particles are dispersed.

43 Claims, No Drawings

ABRASIVE ARTICLES AND METHOD OF MAKING ABRASIVE ARTICLES

This is a continuation of Application Ser. No. 08/538,183, filed Aug. 23, 1995, now abandoned, which is a continuation of Application Ser. No. 08/214,394, filed Mar. 16, 1994, now abandoned.

BACKGROUND OF THE INVENTION

1. Field of the Invention

This invention relates to abrasive articles, more particularly abrasive articles that comprise abrasive particles, a binder, and a grinding aid.

2. Discussion of the Art

Abrasive articles generally comprise abrasive grains secured within a binder. In a bonded abrasive, the binder bonds the abrasive grains together in a shaped mass. Typically, this shaped mass is in the form of a wheel and thus it is commonly referred to as a grinding wheel. In nonwoven abrasives, the binder bonds the abrasive grains to a lofty, open, fibrous substrate. In coated abrasives, the binder bonds the abrasive grains to a substrate or backing. Coated abrasives may comprise a first coated layer bonded to one side of the backing (commonly referred to as a make coating), at least one layer of abrasive grains bonded to the backing by the make coating, and a second coating layer overlaying the abrasive particles. The second coating layer commonly is referred to as a size coating; it reinforces the retention of the abrasive particles. Coated abrasives also may include an additional "supersize" coating overlaying the size coating. The supersize coating can include a grinding aid, which in some instances is beneficial during grinding.

Abrasive binders typically consist of a glutinous or resinous adhesive, and, optionally, additional ingredients. Examples of resinous adhesives include phenolic resins, epoxy resins, urethane resins, acrylate resins and ureaformaldehyde resins. Examples of typical additives include grinding aids, fillers, wetting agents, surfactants, pigments, coupling agents, and dyes.

The addition of grinding aids can significantly affect the chemical and physical processes of abrading metals to bring about improved performance. It is believed that grinding aids either (1) decrease the friction between the abrasive grains and the workpiece being abraded, (2) prevent the abrasive grains from "capping", i.e., prevent metal particles from becoming welded to the tops of the abrasive grains, (3) decrease the interface temperature between the abrasive grains and the workpiece, and/or (4) decrease the required grinding force. Grinding aids are particularly beneficial during the abrading of metals such as stainless steel or titanium. In some instances, the addition of a grinding aid can significantly improve the cut rate or abrading properties of the resulting coated abrasive over a coated abrasive that does not contain a grinding aid. The abrasive industry is always looking for ways to improve the efficiency of abrasive products through the use of grinding aids.

In some instances, the grinding aid and abrasive binder are not compatible. This incompatibility can lead to problems during processing and ultimately decrease performance. Thus, the abrasive industry is looking at ways to further optimize existing grinding aids.

SUMMARY OF THE INVENTION

The invention features an abrasive article, comprising a peripheral surface for contacting and abrading a workpiece, which allows higher loadings of grinding aid. The abrasive article comprises a plurality of abrasive particles and a plurality of grinding aid particles, the latter coated with an inert, hydrophobic, hydrocarbon-containing substance, and a binder in which the abrasive particles and coated grinding aid particles are dispersed. The abrasive particles and grinding aid particles can be (1) adhered together in a porous, shaped mass by the binder (thus defining a "bonded" abrasive); (2) adhered to a backing by the binder (thus defining a "coated abrasive"); or (3) adhered to the fibers of a lofty, open nonwoven web by the binder (thus defining a "nonwoven" abrasive).

Preferred hydrophobic substances include those that are non-polymeric and are not capable of becoming polymeric. In some preferred embodiments, the hydrophobic substance is a fatty acid or a fatty acid salt. The preferred salts include lithium, zinc, sodium, aluminum, nickel, lead, magnesium, calcium, and barium salts. In other preferred embodiments, the hydrophobic material is an oil such as mineral oil or peanut oil.

Preferred grinding aid particles include organic halide compounds, halide salts, and metal halides. Particularly preferred grinding aid particles are cryolite and potassium tetrafluoroborate.

Particularly preferred abrasive articles include a peripheral coating comprising the grinding aid particles and a binder. The peripheral coating contacts the workpiece during abrading. In coated abrasive articles, the term peripheral coating typically refers to either a size or supersize coating that is the outermost coating on the abrasive surface of the article. The peripheral coating preferably comprises a thermoset binder. A preferred peripheral coating comprises potassium tetrafluoroborate particles coated with the hydrophobic substance, and a choice of a thermosetting, an epoxy, or a phenolic resin as the binder.

In another aspect, the invention features grinding aid particles coated with an inert, hydrophobic, hydrocarbon-containing substance.

In another aspect, the invention features erodible agglomerates comprising the coated grinding aid particles of the invention. The agglomerates optionally comprise a binder that adheres the grinding aid particles together. Erodible grinding aid agglomerates without an organic-based binder are described in U.S. Pat. No. 5,269,821, which is hereby incorporated by reference herein.

In another aspect, the invention features a method of abrading a workpiece with an abrasive article having a surface adapted to contact and abrade a workpiece. The abrasive article comprises a plurality of abrasive particles, a plurality of the coated grinding aid particles of the invention, and a binder in which the abrasive particles and the grinding aid particles are dispersed. The method comprises contacting the workpiece (e.g., a metal workpiece) with the surface of the abrasive article while the workpiece and the surface are in relative motion and with sufficient force to abrade the workpiece.

In another aspect, the invention features a method of preparing an abrasive article. A preferred method includes (1) coating a plurality of grinding aid particles with an inert, hydrophobic, hydrocarbon-containing substance, (2) dispersing the coated grinding aid particles and a plurality of abrasive particles into a binder precursor, and (3) solidifying the binder precursor. Preferred binders include phenolic resins.

Grinding aid particles having the hydrophobic coating of the invention display reduced particle-particle attraction.

Thus, the coated grinding aid particles have increased stability and compatibility when processed with aqueous resin systems. As a result, there is a reduced need to include antifoam agents or wetting agents in aqueous resin systems used to make a size or supersize coating that includes the coated grinding aid particles. In addition, the hydrophobic coating on the grinding aid particles may enhance the erodability of the grinding aid layer, thus enhancing the performance of the abrasive article. Further, with the application of the hydrophobic coating, larger grinding aid particles (e.g., those have an average particle size of larger than 100 micrometers) may be incorporated into the preferred thermoset binder precursor, reducing the need and expense of pulverizing the grinding aid, and the subsequent addition of a wetting agent. Wetting agents often are ineffective when attempting to disperse coarse grinding aid particles.

The phrase "abrasive particles", as used herein, includes both individual abrasive grains and multi-grain granules composed of a plurality of abrasive grains.

The term "coated" as used herein to describe the coated grinding aid particles, means a layer on at least a portion of the grinding aid particle that is less than about 20 micrometers thick.

The term "inert", as used herein, means that the substance is unreactive with typical abrasive binders. The term "hydrophobic", as used herein, means that the substance does not adsorb or absorb water. The term "hydrocarbon-containing", as used herein, means that the substance includes at least an eight carbon portion consisting only of carbon and hydrogen. The hydrocarbon portion can be cyclic or noncyclic, branched or unbranched, and saturated or unsaturated.

The term "fatty acid" as used herein, means a straight-chain or substantially straight-chain hydrocarbon including a carboxylic acid group and at least eight carbon atoms. Fatty acids can be saturated or unsaturated.

The term "oil" as used herein, encompasses two types of substances: (1) fatty acid esters of glycerol; and (2) polycyclic hydrocarbons derived from petroleum and its products having a boiling point of above 300° C.

The term "thermoset" resin, as used herein, means a cured resin that has been exposed to an energy source (e.g., heat and/or radiation) sufficient to make the resin incapable of flowing. The term "thermosetting" means an uncured thermoset resin.

The term "erodible" as used herein, means that the agglomerate has the ability to break down in a controlled manner, for example, by fracture due to mechanical stress and/or by dissolving fully or in part under wet grinding conditions. "Wet" means grinding conditions where a water spray or flood is used.

Coated abrasive articles commonly include a make coating and a size coating, and also can include a supersize coating. Each of these coatings include a binder. The phrase "binder in which said grinding aid particles are dispersed" as used herein in the context of coated abrasive articles, means the combination of binders used in the make, size, and (if present) supersize coatings.

The term "dispersed", as used herein, does not necessarily denote a uniform dispersion.

Other features and advantages of the invention will be apparent from the Description of the Preferred Embodiments thereof, and from the claims.

DESCRIPTION OF THE PREFERRED EMBODIMENTS

The preferred abrasive article is a coated abrasive that comprises a backing having coated thereon a coating comprising abrasive particles, grinding aid particles coated with an inert, hydrophobic, hydrocarbon-containing substance, and a binder in which the abrasive particles and the coated grinding aid particles are dispersed.

The backing can be any conventional abrasive backing that is compatible with the binder. Examples include polymeric film, primed polymeric film, reinforced thermoplastics, cloth, paper, vulcanized fiber, nonwovens, and combinations thereof. Specifically preferred backings include those described in assignee's published European patent applications WO 9312911 and WO 9312912, both published Jul. 8, 1993. Both of these references describe thermoplastic backings having fibrous reinforcement therein. These applications are hereby incorporated by reference. The backing may also contain a treatment or treatments to seal the backing and/or modify some physical properties of the backing. These treatments are known in the art.

The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in the assignee's U.S. Pat. No. 5,201,101, which is hereby incorporated herein by reference.

The abrasive particles typically have a particle size ranging from about 0.1 to 1500 micrometers, usually between about 0.1 to 400 micrometers, preferably between 0.1 to 100 micrometers and most preferably between 0.1 to 50 micrometers. The preferred abrasive particles have a Mohs' hardness of at least about 8, more preferably above 9. Examples of suitable abrasive particles include fused aluminum oxide (which includes brown aluminum oxide, heat treated aluminum oxide, and white aluminum oxide), ceramic aluminum oxide, green silicon carbide, black silicon carbide, chromia, alumina zirconia, diamond, iron oxide, ceria, cubic boron nitride, boron carbide, garnet, and combinations thereof.

The abrasive particles also may include single abrasive grains bonded together to form an abrasive agglomerate. Abrasive agglomerates are described, for example, in U.S. Pat. Nos. 4,311,489, 4,652,275, and 4,799,939, which are hereby incorporated by reference.

Grinding aid particles that can be used in the invention include inorganic halide salts, halogenated compounds and polymers, and organic and inorganic sulfur-containing materials. The preferred grinding aids are halide salts, particularly potassium tetrafluoroborate ($KBF_4$), cryolite ($Na_3AlF_6$), and ammonium cryolite [$(NH_4)_3AlF_6$]. Other halide salts that can be used as grinding aids include sodium chloride, potassium cryolite, sodium tetrafluoroborate, silicon fluorides, potassium chloride, and magnesium chloride. Other preferred grinding aids are those in U.S. Pat. No. 5,269,821, which describes grinding aid agglomerates comprised of water soluble and water insoluble grinding aid particles. This patent is hereby incorporated by reference. Other useful grinding aid agglomerates are those wherein a plurality of grinding aid particles are bound together into an agglomerate with a binder. Agglomerates of this type are described in the application filed by Gagliardi and Chesley on this day (Mar. 16, 1994) entitled Abrasive Articles and Method of Making Abrasive Articles (U.S. Ser. No. 08/213,550), and in the application filed by Gagliardi, Chesley, and Houck on this day (Mar. 16, 1994) also entitled Abrasive Articles and Method of Making Abrasive Articles (U.S. Ser. No. 08/213,541). Both of these applications are subject to assignment to the same assignee as the present application, and both are hereby incorporated by reference.

Examples of halogenated polymers useful as grinding aids include polyvinyl halides (e.g., polyvinyl chloride) and polyvinylidene halides such as those disclosed in U.S. Pat. No. 3,616,580; highly chlorinated paraffin waxes such as those disclosed in U.S. Pat. No. 3,676,092; completely chlorinated hydrocarbons resins such as those disclosed in U.S. Pat. No. 3,784,365; and fluorocarbons such as polytetrafluoroethylene and polytrifluorochloroethylene as disclosed in U.S. Pat. No. 3,869,834.

Inorganic sulfur-containing materials useful as grinding aids include elemental sulfur, cupric sulfide, molybdenum sulfide, potassium sulfate, and the like, as variously disclosed in U.S. Pat. Nos. 3,833,346, 3,868,232, and 4,475,926. Organic sulfur-containing materials for use in the invention include those mentioned in U.S. Pat. No. 3,058,819 (e.g., thiourea).

The grinding aid particles have an average particle size ranging from about 1 micrometer to about 100 micrometers, and more preferably ranging from about 5 micrometers to about 50 micrometers. A sufficient quantity of the grinding aid particles should be included in the article to provide the desired increase in grinding efficiency.

The preferred inert, hydrophobic, hydrocarbon-containing, substances are fatty acids, fatty acid salts, and oils.

Preferred fatty acids (and fatty acid salts) include from 12 and 20 carbon atoms.

Preferred fatty acid salts include calcium, lithium, aluminum, nickel, lead, and barium salts of stearic acid. More preferred fatty acid salts include zinc and magnesium salts. It is preferred that the fatty acid salt have a melting point of between 110° C. and 150° C. Melting point can be determined according to ASTM E 324-79 (Reapproved 1989). During abrading applications, a considerable amount of heat can be generated. This heat may soften the coated grinding aid particles to the point that the performance of the coated abrasive is substantially reduced; if the melting point of the fatty acid salt is too low, the coated grinding aid particles may smear the workpiece being abraded. In addition, if the melting point of the fatty acid salt is too low, it may detrimentally affect the curing of the binder(s). Metal stearates generally have a melting point in the range of 120° C–200° C. The coating may also include a blend of different fatty acid salts. Besides metal stearates, other fatty acids also contemplated in this invention. For example, metal palmitates, metal myristates, metal laurates, metal decanoates and metal octanoates. The fatty acid can also be unsaturated as in the case of metal undecylenates or metal oleates.

The coating on the grinding aid particles may also act as a lubricant, thereby improving the performance of the abrasive article.

The preferred oils include peanut oil and mineral oil. The oil preferably is water insoluble and is soluble in alcohols such as isopropyl alcohol.

When the coating is applied, the majority of the grinding aid particles will have some type of coating. However, there may be a portion of the total grinding aid particles (or a portion of each individual particle) that do not have a coating due to the inefficiency of the coating process. However, to alter or change the wetting characteristics of grinding aid particles, only portions of the surface of these particles need to be coated. It is preferred, however, that all of the grinding aid particles are coated. Additionally, the coating will typically cover at least 50 percent, preferably at least 65 percent, more preferably at least 80 percent, and most preferably at least 95 percent of the grinding aid particle's surface area.

The hydrophobic coating preferably is sufficiently thick so as to: (1) minimize any undesirable reaction between the binder and the grinding aid particles; (2) provide better processing during the manufacture of the abrasive article; and/or (3) improve the resulting performance of the abrasive article. The better processing may relate to better rheology, less clumping of the grinding aid particles, and the like. The coating thickness, in part, is a function of the coating material chemistry, coating material size, and the binder. In general, however, the average thickness of the coating preferably is between about 0.5 and 20 micrometers, and more preferably is between about 1 and 10 micrometers. It should be noted that the minimum coating thickness corresponds to the average particle or molecular size of the inert, hydrophobic coating material.

The inert, hydrophobic coating may be applied by any conventional technique such as tumbling, spraying, spinning, and the like. If desired the inert, hydrophobic coating may further include an organic solvent. After coating, the solvent is removed. The inert, hydrophobic coating may also be generated in-situ in a heterogeneous medium, for example, a gas or liquid phase.

The binder can be any of the conventional resinous or glutinous adhesives used in coated abrasives. Examples of resinous adhesives include phenolic resins, urea formaldehyde resins, urethane resins, acrylate resins, aminoplast resins, epoxy resins, latices, and combinations thereof.

The coated abrasive articles are made by conventional techniques. For example, the coated abrasive can be prepared by: (1) applying a make coat precursor to the backing; (2) drop coating or electrostatically coating the abrasive particles onto the precursor; (3) partially curing the make coat precursor; (4) applying a size coat precursor including the grinding aid particles coated with the hydrophobic substance; and (5) fully curing the make and size coat precursors. The second step can encompass the application of blends of coarse grinding aid particles (the same size as the abrasive grains) coated with a hydrophobic material.

The coated grinding aid particles of the invention also can be incorporated into the coated abrasive articles described, for example, in U.S. Pat. No. 5,152,917, which is hereby incorporated by reference herein. These coated abrasive articles include a non-random array of abrasive composites attached to a backing. Each abrasive composite can include abrasive particles, the coated grinding aid particles of the invention, and a binder that binds the abrasive particles and coating grinding aid particles together to form an abrasive composite having a precise shape. Similarly, coated abrasive articles that include a random array of abrasive composites attached to a backing are described in assignee's U.S. patent application U.S. Ser. No. 08/120,300 (Hoopman et al.), which is hereby incorporated by reference.

The coated abrasive articles also may include a supersize coating that is applied over the size coating. The supersize coating preferably includes the grinding aid particles coated with the hydrophobic substance; in this embodiment the coated grinding aid particles optionally can be left out of the size coatings. The size and/or supersize coatings preferably consist of between 10 percent to 95 percent, preferably 30 to 80 percent, and more preferably 50 to 80 percent by weight of coated grinding aid particles. The remainder is the binder and optional additives.

The size and/or supersize coatings can optionally include other additives or ingredients, such as fillers, fibers, lubricants, wetting agents, thixotropic agents, surfactants, pigments, dyes, antistatic agents, coupling agents, plasticizers, and suspending agents.

The coated grinding aid particles also may be incorporated into erodible grinding aid agglomerates, which typically also include a binder to adhere the grinding aid particles together. The erodible agglomerates then in turn may be incorporated into the coated abrasive article. The erodible agglomerates can be incorporated into the make, size, and/or supersize coatings. They can be incorporated between, above, and/or below the abrasive grains. Preferably, the erodible agglomerates will include between 50 and 99 percent of the grinding aid particles by weight, and between 1 and 50 percent of the binder by weight. Preferred erodible agglomerates have an average size of between 20 and 750 micrometers, more preferably between 100 and 700 micrometers.

The coated abrasives of the invention can be used for abrading metals, including stainless steel and titanium. As used herein the term "abrading" is used generally to include grinding, polishing, finishing, and the like.

The most generic method of abrading metal workpieces includes contacting the workpiece with the peripheral surface of an abrasive article, with sufficient force (typically more than about 1 kg/cm$^2$) to abrade the metal workpiece while the peripheral surface and workpiece are moving in relation to each other. Either the workpiece or the abrasive article is preferably stationary.

A general reference for grinding of metals is Chapter 7 of the book entitled "Coated Abrasives—Modern Tool of Industry", pp. 150–200, published by the Coated Abrasives Manufacturers' Institute in 1958. As stated therein, for each application there is an optimum combination of a particular kind of coated abrasive used in a specific grade sequence and the right type of equipment which will give the best results in terms of production, finish, and cost. Factors to be considered are the metallurgy of the workpiece, the shape, size, and condition of the workpiece, the power of the equipment to be used, type of contact wheel used, and the desired finish of the workpiece.

The coated abrasive can be shaped in the form of a belt, disc, sheet, or the like.

In embodiments in which the abrasive article is a continuous abrasive belt, the choice of contact wheel, force employed, and abrasive belt speed depends on the desired rate of cut and the resulting surface finish on the workpiece, care being taken not to damage the workpiece. The contact wheel may be plain or serrated. The force exerted on the workpiece by the abrasive (or vice-versa) may range from 0.05 kilogram (kg) to 150 kg, typically and preferably from about 0.1 kg to about 100 kg. The belt speed may range from 305 surface meters per minute (smpm) to 3,050 smpm, more typically and preferably from about 415 smpm to about 2,134 smpm.

The following examples and test procedures will further illustrate the preferred abrasives, and the methods of making and using the same.

TEST PROCEDURE I

The coated abrasive article of each example was then converted into 7.6 cm by 335 cm endless abrasive belts. Two belts from each example were tested on a constant load surface grinder. A preweighed, 304 stainless steel workpiece approximately 2.5 cm by 5 cm by 18 cm was mounted in a holder, positioned vertically, with the 2.5 cm by 18 cm face confronting approximately 36 cm diameter 60 Shore A durometer serrated rubber contact wheel and one on one lands over which entrained the coated abrasive belt. The workpiece was then reciprocated vertically through a 18 cm path at the rate of 20 cycles per minute, while a spring-loaded plunger urged the workpiece against the belt with a load of 11.0 kg as the belt was driven at about 2,050 meters per minute. After thirty seconds of grinding time had elapsed, the workpiece holder assembly was removed and reweighed, the amount of stock removed calculated by subtracting the weight after abrading from the original weight. Then a new, preweighed workpiece and holder were mounted on the equipment. The experimental error on this test was about ten percent. The total cut is a measure of the total amount of stainless steel removed throughout the test. The test was deemed ended when the amount of final cut was less than one third the amount of initial cut for two consecutive thirty second intervals.

TEST PROCEDURE II

Fiber discs having a diameter of 17.8 cm, with a 2.2 cm diameter center hole and thickness of 0.76 mm were installed on a slide action testing machine. The fiber discs were first conventionally flexed to controllably break the hard bonding resins, mounted on a beveled aluminum back-up pad, and used to grind the face of an 1.25 cm by 19.8 cm 304 stainless steel workpiece. The disc was driven at 5,500 rpm while the portion of the disc overlaying the beveled edge of the back-up pad contacted the workpiece at 5.91 kg pressure, generating a disc wear path of about 140 cm$^2$. Each disc was used to grind a separate workpiece for one 5 minute each, for a total time of 10 minutes each.

| Materials | |
|---|---|
| BPAW: | A composition containing a diglycidyl ether of bisphenol A epoxy resin coatable from water containing approximately 60 percent solids and 40 percent water. This composition, which had the trade designation "CMD 35201", was purchased from Rhone-Poulene, Inc., Louisville, Kentucky. This composition also contained a nonionic emulsifier. The epoxy equivalent weight ranged from about 600 to about 700. |
| RPI: | A resole phenolic resin with 75 percent solids (non-volatile). |
| EMI: | 2-Ethyl-4-methyl imidazole. This curing agent, which had the designation "EMI-24", was commercially available from Air Products, Allentown, Pennsylvania. |
| $KBF_4$-102: | 98 percent pure pulverized potassium tetrafluoroborate, in which at least 90 percent of the particles by weight pass through a 200 mesh screen. The particles have an average size of about 50 micrometers. This composition, which had the trade designation "Potassium Fluoroborate Spec 102," was purchased from Atotech USA, Somerset, NJ |
| $KBF_4$-104: | 98 percent pure potassium tetrafluoroborate, in which at most 2 percent of the particles by weight are coarser than 60 mesh, at least 25 percent of the particles by weight pass through a 200 mesh screen, and at most 5 percent of the particles by weight pass through a 325 mesh screen. The particles have an average size of about 125 micrometers. This composition, which had the trade designation "Potassium Fluoroborate Spec 104," was purchased from Atotech USA, Somerset, NJ |
| CRY: | Cryolite (trisodium hexafluoroaluminate). |
| IO: | Red iron oxide. |
| HP: | A mixture of 85 percent 2-methoxy propanol and 15 percent $H_2O$, commercially available from Worum Chemical Co., St. Paul, MN. |
| AOT: | A dispersing agent (sodium dioctyl sulfosuccinate), which had the trade designation |

-continued

| Materials | |
|---|---|
| | "Aerosol OT" was commercially available from Rohm and Haas Company. |
| $Zn(St)_2$: | Zinc stearate 42, powder. Commercially available from Organic Division, Witco, Perth Amboy, NJ; 99.9 percent of the powder by weight passes through 325 mesh screen. The particles have an average size of 5 to 10 micrometers. |
| NaSt: | Sodium Stearate T-1, powder. Commercially available from Witco. 93 percent of the powder by weight passes through 100 mesh screen (particles are not more than 149 micrometers in size). |
| $Mg(St)_2$: | Magnesium Stearate NF Hyqual, powder. Available from Mallinckrodt, Chesterfield, MO. At least 99.5 percent of the powder by weight passes through 325 mesh screen (particles are not more than 44 micrometers in size). |
| $Al(St)_3$: | Aluminum Stearate #132D, powder. Available from Witco. 95 percent of the powder passes through 200 mesh screen (particles are not more than 74 micrometers in size). |
| StA: | Stearic Acid, CAS 57-11-4, powder. Available from EM Science, Cherry Hill, NJ. |
| MO: | Mineral Oil, #79300. Available from Paddock, Minneapolis, MN. |
| PnO: | 100 percent Pure Peanut Oil. Available from Planters, Winston-Salem, NC. |

General Procedure for Making Coated Abrasives (belts)

For the following examples made using this procedure, the backing of each coated abrasive consisted of a Y weight woven polyester cloth which had a four over one weave. Each backing was saturated with a latex/phenolic resin and then placed in an oven to partially cure this resin. Next, a calcium carbonate-filled latex/phenolic resin pretreatment coating was applied to the back side of each backing. Each coated backing was heated to about 120° C. and maintained at this temperature until the resin had cured to a tack-free state. Finally, a pretreatment coating of latex/phenolic resin was applied to the front side of each coated backing and each coated backing was heated to about 120° C. and maintained at this temperature until the resin had precured to a tack-free state. Each backing made by this procedure was completely pretreated and was ready to receive a make coat.

A coatable mixture for producing a make coating for each coated backing was prepared by mixing 69 parts of 70 percent solids phenolic resin (48 parts phenolic resin), 52 parts non-agglomerated calcium carbonate filler (dry weight basis), and enough of a solution of 90 parts water/10 parts ethylene glycol monoethyl ether to form a make coating in each case which was 84 percent solids, with a wet coating weight of 155 g/m$^2$. The make coating was applied in each case via knife coating. This make coating was allowed to dry at ambient conditions overnight.

Next, grade 36 (ANSI standard B74.18 average particles size of 545 micrometers) ceramic aluminum oxide abrasive particles were drop coated onto the uncured make coatings with a weight of 827 g/m$^2$ .

Then the resulting constructions received a precure of 15 minutes at 65° , followed by 75 minutes at 88° .

An approximately 82 percent solids coatable mixture suitable for forming a size coating (having the composition described in the following examples) was then applied over the abrasive particles/make coat construction via two-roll coater. The wet size coating weight in each case was about 465 g/m$^2$. The resulting coated abrasives received a thermal cure of 30 minutes at 88° C. followed by 12 hours at 100° C.

After this thermal cure, the coated abrasives were single flexed (i.e., passed over a roller at an angle of 90° C. to allow a controlled cracking of the make and size coatings), then converted into 7.6 cm by 335 cm coated abrasive belts.

General Procedure for Making Coated Abrasives (Discs)

A coated abrasive disc was prepared according to the following procedure. A 0.76 mm thick vulcanized fibre backing having a 2.2 cm diameter center hole was coated with a conventional calcium carbonate filled resole phenolic resin (83 percent by weight solids) to form a make coat. The wet coating weight was approximately 164 g/m$^2$. Grade 36 ceramic aluminum oxide abrasive grains were electrostatically coated onto the make coating at a weight of approximately 740 g/m$^2$. The resulting abrasive article was precured for 150 minutes at 93° . A size composition consisting of 32 percent RP1, 50.2 percent CRY, 1.5 percent IO, and 16.3 percent HP was applied over the abrasive grains and the make coating at an average weight of approximately 699 g/m$^2$ to form a size coat. The resulting product was cured for 11½ hours to 93° C. After this step, the coated abrasive discs were flexed and humidified at 45 percent RH for one week prior to testing.

Procedure for Preparing Coated Grinding Aids

The hydrophobic component was dispersed into a solvent. Then, the grinding aid was added slowly to the dispersion with stirring. This slurry was transferred to an aluminum tray and placed in an oven at 90° C. to evaporate the solvent. The excess solid hydrophobic component, that is, material that was not deposited on a grinding aid particle, was screened off accordingly.

A similar procedure involves an additional step in which zinc nitrate solution is added slowly to a mixture containing sodium stearate (see G-2) which forms a coagulum-type product. The total mixture is dried as above.

Table I lists the formulations (G-1 through G-9) of coated grinding aids used in the examples of this patent application.

TABLE I

| | COATING OF GRINDING AIDS | | | | | | | | |
|---|---|---|---|---|---|---|---|---|---|
| | G-1 | G-2 | G-3 | G-4 | G-5 | G-6 | G-7 | G-8 | G-9 |
| GRINDING AID: | | | | | | | | | |
| $KBF_4$ | 20 | 20 | 20 | 20 | — | — | 100 | 100 | 20 |
| CRY | — | — | — | — | 100 | 100 | — | — | — |
| COATING COMPOSITION: | | | | | | | | | |
| Zn(St)2 | 1 | — | — | — | 2 | — | — | — | 0.4 |
| NaSt | — | 0.5 | — | — | — | — | — | — | — |

TABLE I-continued

| | COATING OF GRINDING AIDS | | | | | | | | |
|---|---|---|---|---|---|---|---|---|---|
| | G-1 | G-2 | G-3 | G-4 | G-5 | G-6 | G-7 | G-8 | G-9 |
| $Al(St)_3$ | — | — | — | 1 | — | — | — | — | — |
| MO | — | — | — | — | — | — | 3 | — | — |
| $Mg(St)_2$ | — | — | 1 | — | — | — | — | — | — |
| PnO | — | — | — | — | — | — | — | 3 | — |
| StA | — | — | — | — | — | 2 | — | — | — |
| SOLVENT: | | | | | | | | | |
| Methanol | 10 | — | 10 | 10 | — | — | — | — | 10 |
| Isopropanol | — | — | — | — | 50 | 50 | 50 | 50 | — |
| $H_2O$ | — | 25 | — | — | — | — | — | — | — |
| ADDITIVE: | | | | | | | | | |
| $NH_4OH$ | — | — | — | — | — | — | — | — | — |
| Zinc Nitrate | — | 0.2 | — | — | — | — | — | — | — |
| ISOLATION METHOD* | D | P/D | D | D | D | D | D | D | D |

* = D = drying in oven
P/D = precipitation followed by drying in oven

TABLE II

| | SIZE RESIN FORMULATIONS | | | | | |
|---|---|---|---|---|---|---|
| | A | 1 | 6 | 7 | 8 | 9 |
| RP1 | 32.0 | 38.5 | 32.0 | 32.0 | 32.0 | 32.0 |
| IO | 1.5 | 1.8 | 1.5 | 1.5 | 1.5 | 1.5 |
| HP | 13.9 | 16.8 | 13.9 | 13.9 | 13.9 | 13.9 |
| W | 2.4 | 2.9 | 2.4 | 2.4 | 2.4 | 2.4 |
| CRY | 50.2 | — | — | — | — | — |
| G-1 | — | 40.0 | — | — | — | — |
| G-5 | — | — | 50.2 | — | — | — |
| G-6 | — | — | — | 50.2 | — | — |
| G-7 | — | — | — | — | 50.2 | — |
| G-8 | — | — | — | — | — | 50.2 |

TABLE III

| | SUPERSIZE RESIN FORMULATIONS | | | | | | |
|---|---|---|---|---|---|---|---|
| | B | 2 | 3 | 4 | 5 | 10 | 11 |
| BPAW | 29.2 | 28.2 | 22.0 | 28.2 | 28.2 | 24.9 | 26.9 |
| EMI | 0.35 | 0.30 | 0.25 | 0.3 | 0.3 | 0.33 | 0.33 |
| W | 14.1 | 13.6 | 10.5 | 13.6 | 13.6 | 12.1 | 13.0 |
| AOT | 0.75 | 0.70 | 0.55 | 0.7 | 0.7 | 0.67 | 0.67 |
| IO | 2.3 | 2.2 | 1.7 | 2.2 | 2.2 | 2.0 | 2.1 |
| $KBF_4$ | 53.3 | — | — | — | — | — | — |
| G-1 | — | 55.0 | 65.0 | — | — | 60.0 | — |
| G-3 | — | — | — | 55.0 | — | — | — |
| G-4 | — | — | — | — | 55.0 | — | — |
| G-9 | — | — | — | — | — | — | 57.0 |

EXAMPLE 1 AND COMPARATIVE EXAMPLE A

The coated abrasives for Example 1 and Comparative Example A were made according to the General Procedure for Making Coated Abrasives (Discs). These examples compare the abrading characteristics of coated abrasive articles of the invention. The coated abrasive articles were sized with the formulations as designated in Table II having 40 percent by weight of zinc stearate coated $KBF_4$-104 in Example 1 compared with 50.2 percent by weight cryolite in Comparative Example A. Test Procedure II was utilized to test these examples. The performance results are tabulated in Table IV.

TABLE IV

| EFFECTS OF $Zn(St)_2/KBF_4$-104 IN SIZE | | | |
|---|---|---|---|
| Example No. | Initial Cut (% of Control) | Final Cut (% of control) | Total Cut (% of control) |
| Comparative A | 100 | 100 | 100 |
| 1 | 94 | 108 | 107 |

EXAMPLES 2 THROUGH 5 AND COMPARATIVE EXAMPLE B

The coated abrasives for Examples 2–5 and Comparative Example B were made according to the General Procedure for Making Coated Abrasive (Discs). These examples compare the abrading characteristics of coated abrasive articles of the invention. The coated abrasive discs were supersized with the formulations as designated in Table III having variables of the concentration of grinding aid ($KBF_4$) and the type of stearate coating on $KBF_4$, i.e., $Zn(St)_2$ vs. $Mg(St)_2$ vs. $Al(St)_3$. Test Procedure II was utilized to evaluate these examples. The performance results are tabulated in Table V.

TABLE V

| EFFECTS OF STEARATE-COATED $KBF_4$-104 IN SUPERSIZE | | | |
|---|---|---|---|
| Example No. | Initial Cut (% of Control) | Final Cut (% of Control) | Total Cut (% of Control) |
| Comparative B | 100 | 100 | 100 |
| 2 | 106.2 | 185.9 | 146.5 |
| 3 | 111.0 | 189.6 | 153.1 |
| 4 | 102.9 | 98.5 | 98.6 |
| 5 | 83.6 | 93.5 | 81.5 |

EXAMPLES 6 THROUGH 9 AND CCOMPARATIVE EXAMPLE A

The coated abrasives for Examples 6–9 and Comparative Example A were made according to the General Procedure for Making Coated Abrasives (Discs). These examples compare the abrading characteristics of coated abrasive articles of this invention. The coated abrasive discs were sized with the formulations as designated in Table II having a stearate type coating on cryolite in Examples 6 and 7, an oil type coating on $KBF_4$-102 in Examples 8 and 9, and for comparison, uncoated cryolite in Comparative Example A. Test procedure II was utilized to test these examples. The performance results are tabulated in Table VI.

TABLE VI

EFFECTS OF COATINGS ON VARIOUS GRINDING AIDS IN SIZE FORMULATIONS

| Example No. | Initial Cut (% of Control) | Final Cut (% of Control) | Total Cut (% of Control) |
|---|---|---|---|
| Comparative A | 100.0 | 100.0 | 100.0 |
| 6 | 138.5 | 108.6 | 141.1 |
| 7 | 122.7 | 109.9 | 146.9 |
| 8 | 83.0 | 122.3 | 117.2 |
| 9 | 73.3 | 93.3 | 85.8 |

EXAMPLES 10 AND 11 AND COMPARATIVE EXAMPLE C

The coated abrasives for Examples 10 and 11 and Comparative Example C were made according to the General Procedure for Making Coated Abrasives (Belts). These examples compare the abrading characteristics of coated abrasive articles of the invention. The coated abrasive belts were supersized with the formulations as designated in Table III having variables of the concentration of grinding aid ($KBF_4$) and the concentration of zinc stearate, $Zn(St)_2$, coating on $KBF_4$. Test Procedure I was used to test these examples. The performance results are tabulated in Table VII.

TABLE VII

EFFECTS OF $Zn(St)_2/KBF_4$-104 ON SUPERSIZE (BELT TESTS)

| Example No. | Initial Cut (% of Control) | Final Cut (% of Control) | Total Cut (% of Control) |
|---|---|---|---|
| Comparative C | 100.0 | 100.0 | 100.0 |
| 10 | 102.0 | 105.2 | 107.6 |
| 11 | 97.1 | 96.8 | 88.6 |

OTHER EMBODIMENTS

Other embodiments are within the claims. For example, the abrasive particles and the coated grinding aid particles of the invention particles can be incorporated into bonded abrasive articles. The grinding aid particles, along with the abrasive particles, may be dispersed throughout the binder used to form the bonded abrasive articles. Alternatively, a binder precursor containing the grinding aid particles may be applied as a peripheral surface coating on a bonded abrasive, or to voids within the bonded abrasive; the binder precursor can then be cured or solidified by known methods. The bonded abrasive can be a conventional flexible bonded abrasive employing an elastomeric polyurethane as the binder matrix. The polyurethane binder matrix may be a foam as disclosed in U.S. Pat. Nos. 4,613,345; 4,459,779; 2,972,527; 3,850,589; UK Patent Specification No. 1,245,373 (published Sep. 8, 1971); or the polyurethane binder may be a solid, as disclosed in U.S. Patent Nos. 3,982,359; 4,049,396; 4,221,572; 4,933,373; and 5,250,085. All of these patents are hereby incorporated herein.

Detailed below is a general procedure to make a bonded abrasive incorporating the coated grinding aid of the invention. The binder precursor, abrasive particles, coated grinding aid particles, and optional additives are mixed together to form a homogeneous mixture. This mixture is then molded to the desired shape and dimensions. The binder precursor is then cured and solidified to form the bonded abrasive.

The grinding aid particles of the invention also can be incorporated into nonwoven abrasives, which are generally illustrated in U.S. Pat. No. 2,958,593; others are illustrated in U.S. Pat. No. 4,991,362, and U.S. Pat. No. 5,025,596. These patents are hereby incorporated by reference herein. In general nonwoven abrasives included an open, lofty, three-dimensional webs of organic fibers bonded together at points where they contact by an abrasive binder. These webs may be roll coated, spray coated, or coated by other means with binder precursors compositions including the grinding aid particles of the invention, and subsequently subjected to conditions sufficient to cure or solidify the resin.

Detailed below is a general procedure to make a nonwoven abrasive incorporating the coated grinding aid of the invention. The binder precursor, abrasive particles, coated grinding aid particles, and optional additives are mixed together to form a homogeneous mixture. This mixture is then sprayed or coated into a fibrous, lofty, nonwoven substrate. The binder precursor is then cured and solidified to form the nonwoven abrasive.

I claim:

1. An abrasive article having a peripheral surface adapted to contact and abrade a workpiece, said abrasive article comprising a plurality of abrasive particles and a plurality of coated grinding aid particles, said coated grinding aid particles comprising grinding aid particles coated with an inert, hydrophobic, hydrocarbon-containing substance selected from the group consisting of fatty acids, fatty acid salts, and oils, and a binder in which said abrasive particles and said coated grinding aid particles are dispersed.

2. The abrasive article of claim 1, wherein said grinding aid particles are selected from the group consisting of organic halide compounds, halide salts, and metal alloys.

3. The abrasive article of claim 2, wherein said grinding aid particles are selected from the group consisting of cryolite and potassium tetrafluoroborate.

4. The abrasive article of claim 1, wherein said grinding aid particles have an average particle size of between about 1 and 150 micrometers.

5. The abrasive article of claim 1, wherein said coating on said grinding aid particles has an average thickness of between about 0.5 and 20 micrometers.

6. The abrasive article of claim 1, wherein said inert, hydrophobic, hydrocarbon-containing substance is non-polymeric.

7. The abrasive article of claim 1, wherein said inert, hydrophobic, hydrocarbon-containing substance is a lubricant.

8. The abrasive article of claim 1, wherein said substance is a fatty acid salt.

9. The abrasive article of claim 8, wherein said salt is selected from the group consisting of lithium, zinc, sodium, calcium, aluminum, nickel, lead, magnesium, and barium salts.

10. The abrasive article of claim 8, wherein said fatty acid has from 12 to 20 carbon atom.

11. The abrasive article of claim 8, wherein said fatty acid is stearic acid.

12. The abrasive article of claim 8, wherein said fatty acid salt is selected from the group consisting of magnesium stearate, sodium stearate, and aluminum stearate.

13. The abrasive article of claim 8, wherein said grinding aid particles are selected from the group consisting of organic halide compounds, halide salts, and metal alloys.

14. The abrasive article of claim 13, wherein said grinding aid particles comprise potassium tetrafluoroborate.

15. A coated abrasive article having a surface adapted to contact and abrade a workpiece, said coated abrasive article comprising a backing having a major surface, a make coat on said major surface of said backing, a plurality of abrasive particles adhered to said make coat, and a size coat comprising grinding aid particles coated with an inert, hydrophobic, hydrocarbon-containing substance selected from the group consisting of fatty acids, fatty acid salts, and oils.

16. The coated abrasive article of claim 15, wherein said grinding aid particles are selected from the group consisting of organic halide compounds, halide salts, and metal alloys.

17. The coated abrasive article of claim 16, wherein said grinding aid particles are selected from the group consisting of cryolite and potassium tetrafluoroborate.

18. The coated abrasive article of claim 15, wherein said coated abrasive article includes a peripheral coating comprising said binder and said coated grinding aid particles.

19. The coated abrasive article of claim 18, wherein said peripheral coating comprises a thermoset binder.

20. The coated abrasive article of claim 18, wherein said coated grinding aid particles are coated potassium tetrafluoroborate particles and said binder comprises a phenolic resin.

21. The coated abrasive article of claim 18, wherein said grinding aid particles comprise potassium tetrafluoroborate particles having an average particle size of between about 50 and 150 micrometers.

22. The coated abrasive article of claim 15, wherein said grinding aid particles have an particle size of between 1 and 150 micrometers.

23. The coated abrasive article of claim 15, wherein said coating on said coated grinding aid particles has an average thickness of 0.5 and 20 micrometers.

24. The coated abrasive article of claim 15, wherein said inert, hydrophobic, hydrocarbon-containing substance is a lubricant.

25. The coated abrasive article of claim 15, wherein said substance is a fatty acid salt.

26. The coated abrasive article of claim 25, wherein said salt is selected from the group consisting of lithium, zinc, sodium, calcium, aluminum, nickel, lead, magnesium, and barium salts.

27. The coated abrasive article of claim 25, wherein said fatty acid has from 12 to 20 carbon atom.

28. The coated abrasive article of claim 25, wherein said fatty acid is stearic acid.

29. The coated abrasive article of claim 25, wherein said fatty acid salt is selected from the group consisting of magnesium stearate, sodium stearate, and aluminum stearate.

30. The coated abrasive article of claim 15, wherein said grinding aid particles comprise potassium tetrafluoroborate.

31. The coated abrasive article of claim 18, wherein said grinding aid particles comprise potassium tetrafluoroborate and said binder comprises a phenolic resin.

32. The coated abrasive article of claim 31, wherein said potassium tetrafluoroborate particles are coated with a fatty acid salt.

33. The coated abrasive article of claim 31, wherein said potassium tetrafluoroborate particles are coated with an oil selected from the group consisting of mineral oils and peanut oil.

34. A bonded abrasive article having a peripheral surface adapted to contact and abrade a workpiece, said bonded abrasive article comprising a plurality of abrasive particles, a plurality of coated grinding aid particles, said coated grinding aid particles comprising grinding aid particles coated with a substance selected from the group consisting of fatty acids, fatty acid salts, and oils, and a binder in which said abrasive particles and said coated grinding aid particles are dispersed and which bonds said abrasive particles and said coated grinding aid particles together to form a shaped mass.

35. The bonded abrasive article of claim 34, wherein said grinding aid particles comprise potassium tetrafluoroborate.

36. The bonded abrasive article of claim 35, wherein said potassium tetrafluoroborate particles are coated with a fatty acid salt.

37. A nonwoven abrasive having at least one major surface and an interior region, said article comprising an open, lofty web of organic fibers, a plurality of abrasive particles, a plurality of coated grinding aid particles, said coated grinding aid particles comprising grinding aid particles coated within a substance selected from the group consisting of fatty acids, fatty acid salts, and oils, and a binder in which said abrasive particles and said coated grinding aid particles are dispersed and which binds said abrasive particles and said coated grinding aid particles to said open, lofty web.

38. The nonwoven abrasive article of claim 37, wherein said grinding aid particles comprise potassium tetrafluoroborate.

39. The nonwoven abrasive article of claim 37, wherein said potassium tetrafluoroborate particles are coated with a fatty acid salt.

40. A method of making an abrasive article having a surface adapted to contact and abrade a workpiece, said method comprising coating a plurality of grinding aid particles with a substance selected from the group consisting of fatty acids, fatty acid salts, and oils to provide a plurality of coated grinding aid particles;

providing a plurality of abrasive particles;

dispersing said coated grinding aid particles and said abrasive particles in a binder precursor; and solidifying said binder precursor.

41. The method of claim 40, wherein said coated grinding aid particles and said abrasive particles are dispersed in said binder without the use of a dispersing agent or an antifoam agent.

42. A coated abrasive article having a surface adapted to contact and abrade a workpiece, said coated abrasive article comprising a backing having a major surface, a make coat on said major surface of said backing, a plurality of abrasive particles adhered to said make coat, a size coat, and a supersize coat comprising grinding aid particles coated with an inert, hydrophobic, hydrocarbon-containing substance selected from the group consisting of fatty acids, fatty acid salts, and oils.

43. A coated abrasive article having a surface adapted to contact and abrade a workpiece, said coated abrasive article comprising a backing having a major surface, a plurality of abrasive particles, a plurality of coated grinding aid particles, said coated grinding aid particles comprising grinding aid particles coated with a substance selected from the group consisting of fatty acids, fatty acid salts, and oils, and a binder in which said abrasive particles and said coated grinding aid particles are dispersed.

* * * * *